US010717017B2

(12) United States Patent
Publicover et al.

(10) Patent No.: US 10,717,017 B2
(45) Date of Patent: Jul. 21, 2020

(54) BALLOON PLAY APPARATUS OR THE LIKE

(71) Applicants: Mark Publicover, Saratoga, CA (US); Jacob Publicover, Saratoga, CA (US)

(72) Inventors: Mark Publicover, Saratoga, CA (US); Jacob Publicover, San Francisco, CA (US)

( * ) Notice: Subject to any disclaimer, the term of this patent is extended or adjusted under 35 U.S.C. 154(b) by 0 days.

(21) Appl. No.: 15/541,662

(22) PCT Filed: Jan. 6, 2016

(86) PCT No.: PCT/US2016/012397
§ 371 (c)(1),
(2) Date: Jul. 5, 2017

(87) PCT Pub. No.: WO2016/112141
PCT Pub. Date: Jul. 14, 2016

(65) Prior Publication Data

US 2017/0368464 A1 Dec. 28, 2017

Related U.S. Application Data

(60) Provisional application No. 62/100,170, filed on Jan. 6, 2015, provisional application No. 62/262,367, filed on Dec. 2, 2015.

(51) Int. Cl.

| | |
|---|---|
| ***A63H 27/10*** | (2006.01) |
| ***A63H 37/00*** | (2006.01) |
| ***B05B 9/04*** | (2006.01) |
| ***B05B 9/08*** | (2006.01) |

(52) U.S. Cl.
CPC ..... *A63H 27/10* (2013.01); *A63H 37/00* (2013.01); *B05B 9/0403* (2013.01);
(Continued)

(58) Field of Classification Search
CPC ..... A63H 27/10; A63H 37/00; A63H 2027/1083; A63H 2027/1041; A63H 2027/1075; B05B 9/0403; B05B 9/0805
See application file for complete search history.

(56) References Cited

U.S. PATENT DOCUMENTS 2,619,257 A 11/1952 Posner
3,122,130 A 2/1964 Brown et al.
(Continued)

FOREIGN PATENT DOCUMENTS

CN 203648071 6/2014
CN 104273109 A 1/2015
(Continued)

OTHER PUBLICATIONS

World Intellectual Property Organization, International Search Report and Written Opinion issued for International Application No. PCT/US2016/012397 dated Apr. 19, 2016.

*Primary Examiner* — Jeffrey S Vanderveen
(74) *Attorney, Agent, or Firm* — Klarquist Sparkman, LLP

(57) ABSTRACT

A play apparatus has a gas filled balloon and an opening through which fluid is squirted or otherwise released. Fluid is delivered to the opening from an adjacent or nearby reservoir which is connected to at least one hollow tube whereby liquid is transferred from the reservoir to the release point on or adjacent to the balloon, such that the buoyancy of the balloon is unimpeded, for the purposes of play and amusement.

24 Claims, 11 Drawing Sheets

(52) U.S. Cl.
CPC .... *B05B 9/0805* (2013.01); *A63H 2027/1008* (2013.01); *A63H 2027/1041* (2013.01); *A63H 2027/1075* (2013.01); *A63H 2027/1083* (2013.01)

(56) References Cited

U.S. PATENT DOCUMENTS

| | | | |
|---|---|---|---|
| 3,662,487 | A | 5/1972 | Seefluth |
| D315,592 | S | 3/1991 | Tager et al. |
| 5,080,623 | A | 1/1992 | Stein |
| 5,167,554 | A | 12/1992 | Tager et al. |
| 5,306,194 | A | 4/1994 | Epstein |
| 5,403,222 | A | 4/1995 | Koenig et al. |
| 5,566,491 | A | 10/1996 | Phillips |
| 6,551,193 | B1 | 4/2003 | Edwards |
| 7,588,477 | B2 | 9/2009 | Sidwell |
| 7,938,758 | B2 | 5/2011 | Publicover et al. |
| 8,915,826 | B2 | 12/2014 | Publicover et al. |
| 2004/0233674 | A1 | 11/2004 | Vanderschuit |
| 2006/0291217 | A1 | 12/2006 | Vanderschuit |
| 2008/0273319 | A1 | 11/2008 | VanderSchuit |

FOREIGN PATENT DOCUMENTS

| | | | |
|---|---|---|---|
| CN | 104738012 | A | 7/2015 |
| GB | 2486993 | A | 7/2012 |
| GB | 2487289 | A | 7/2012 |
| JP | 2006-167354 | | 6/2006 |
| WO | WO 2004/081905 | | 9/2004 |
| WO | WO 2007/027647 | | 3/2007 |
| WO | WO 2008/008980 | | 1/2008 |

BALLOON PLAY APPARATUS OR THE LIKE

CROSS REFERENCE TO RELATED APPLICATIONS

This claims the benefit of U.S. Provisional Applications Nos. 62/100,170 and 62/262,367, which are incorporated herein by reference in their entireties.

BACKGROUND AND SUMMARY

This disclosure relates to a balloon having an opening which squirts or otherwise releases contained water (or other fluid) from an adjacent or nearby reservoir which is connected to at least one hollow tube or conduit, or rod whereby liquid is transferred from the reservoir to the release point on the balloon for the purposes of play and amusement. Water is the fluid described herein, but any fluid or liquid may be utilized in lieu of water.

The "squirting balloon" apparatus releases or otherwise emits water from the balloon itself or from a location adjacent or nearby the balloon. The water is expelled through an aperture located on an external surface of the apparatus, such as via the orifice of a nozzle, which is located above the level of the ground.

Advantageously the water source is configured so as to not substantially interfere with the balloon's buoyancy, or in such a manner as to prevent the heavier than air balloon from descending, as through a support wire or the like.

In some arrangements, the balloon is configured to be movable via the release of water in any direction and in such a manner as to affect the balloons movement or height above a surface. Or, one or more of a release aperture(s) or can be configured to spin in relation to the balloon or to spin the balloon itself.

In another aspect, the tube may travel from the reservoir and then travel in contact with the balloon toward a single direction with a nozzle at its end (not shown in drawings). This is a very simple configuration which will also propel the balloon in various directions in a three dimensional space.

In some arrangements, a play apparatus is configured such that a balloon is movable due to the release of a gas or compressed air for the reasons just described.

Manipulation of movement can be made with air and water in concert with each other. Such air or water release may serve to propel, support, or otherwise manipulate the balloon in three dimensional space. It could tilt the balloon up or down or side to side. Additionally, the flight or movement of the balloon may be controlled by utilizing the liquid moving up the tube and to the nozzle towards the buoyant balloon. Because balloons have weight concerns and limitations, it has not been considered to use injected water from a reservoir up a tube to an elevated and buoyant balloon. Pure air or gas has been because it is so light, whereas water or other liquids have been ignored as options for moving a balloon in space because of its weight and management with the lighter than air device. Contrary to this thinking, the instant device may utilize liquid to aid in the movement of a balloon and, in some cases, assist in even elevating the balloon. When liquid is moved through the tube it has been found to stiffen the rope or tube member more that when it is empty of liquid. Thus, a balloon has been found to move upward to the extent the flex of the empty tube is firmed up. Additionally, it has been found that a sufficiently buoyant balloon is able to utilize water for the purpose of movement of the balloon.

Additionally, a tube may be utilized for transporting both a gas and liquid, either in concert and simultaneously within the same tube and out the same aperture or nozzle. Mixing these two mediums (water and air, for example) lessens the weight but not the play fun of the device. Additionally, a tube may transport a liquid or gas consecutively, one after the other, and again after the other repeated. This is useful if the liquid reservoir empties and liquid is no longer available to propel the balloon, then a gas, pressurized or not, may be substituted through the same tube. Multiple tubes can be conceived that may each transport gas or liquid both individually or separately. Either liquid or gas may be used to move the balloon.

Additionally, the tube (rope, etc.) that transports the liquid may be configured such that only a portion of the total length from end to end is rigid, while another portion remains flexible. This configuration serves to increase support with less weight than that of an entirely rigid tube member. The rigid portion may be closer to hand of the user; for example it could be projecting from the distant reservoir being held or otherwise with the user's body. At somewhere (anywhere) along the length of the tube, it becomes more flexible. It could go from rigid to flexible at the halfway point between the reservoir and the balloon, or somewhere else along the same tube. The balloon may be like a well-known, common balloon used for parties, and which is usually filled with air, or a lighter than air gas such as helium. Usually, the balloon is attached to a string or other connector so that a person can carry the balloon (as a child might want to) or to attach or otherwise secure to something else, so it won't float or release away. And, where the balloon is filled with a lighter than air gas, the string is held by either a hand or tied or attached to something else to prevent loss by floating away. Such balloons have be in existence for a very long time, and it is no exaggeration to estimate that hundreds of thousands to millions of such gas filled, hand held, balloons are sold annually for decorative and other visual and play purposes around the globe. Whether held by a single child or combined in an elaborate display with multiple types of balloons in various shapes and with pictures or drawings or words placed on them, balloons are a common sight. Also, while the most common shape is that of a sphere or a shape approaching that of a sphere or a more rounded three dimensional shape, other shapes are possible such that any three dimensional polygon may be used with the current apparatus.

The minimum size balloon required to support the tube, water, and nozzle is a 18 inch latex balloon or one made of material with similar properties; or a 31-inch Mylar balloon for example, or one made of material with similar properties. This is for a 5/32" OD and 3/32" ID 4 foot long tube. It is also possible to use multiple smaller balloons such as five 11" latex balloons, or two 16" latex balloons, where one or more utilize a squirting mechanism.

The upper limit is not based simply on the weight; but the cost of lighter than air gases such as helium can make a play apparatus such as the disclosed device more expensive and thus less appealing to purchase if too much is required for buoyancy. Additionally the upper limit is more limited by the intended use, which is as a play apparatus as described and shown. A person, whether a small child or a full sized adult, may use the product and hold the end of the tube or rope or rode (or it is attached in some manner to their body or clothes or a strap or pack. It has been found that the preferred size range will generally not exceed 36 inches in balloon diameter for its intended use of being held by an individual person, however, balloons up to 48 inches in diameter or 34 cubic feet in volume may be used. A 24" latex balloon or a 36" Mylar balloon will readily support the load for the device for such play use, and such balloon sizes are commonly available and are therefore generally not overly expensive to fill with lighter than air gasses such as helium and the like.

The apparatus desirably includes a balloon coupled to a conduit or tube and/or rod at a location between 1 to 10 feet in height or length; meaning the distance between the holding mechanism (near the user's hand for example) and the balloon. Such a balloon may be required to support the entire weight of the conduit or hollow tube and its contents, together with any associated equipment or supporting rod. Such a balloon is therefore preferably capable of providing a lifting force of at least 0.023 pounds. This minimum weight assumes a 1 foot long tube with a thinner inner diameter of approximately 1/32 inches. For a configuration utilizing a conduit or tube as long as 10 feet and a tube with a larger inside diameter of 5/32 inches for example, the balloon must be able to lift at least 0.2 pounds of weight, While larger balloons and larger diameter tubes can be fabricated, the subsequent play value of the apparatus is degraded which reduces the utility of its purpose. The lifting capacity of the balloon or balloons should be less than the amount that would lift an untethered user that is holding the apparatus off of the ground, in particular the balloon should not be so buoyant as to lift the apparatus and an untethered person who weighs more than ten pounds. It is anticipated that the disclosed device and its embodiments will be popular in fairs, concerts, zoos, urban and rural environments as a playful and fun accessory, where the chance of groups of people being near the apparatus is likely. Thus, the user must be mindful of obstructions and obstacles in such environments in a three dimensional space. For example, signs, overhead wires and other unforeseen obstacles may impede the floating balloon. This is more likely in a more crowded environment and less likely in an open rural environment. Another reason the tube is generally not beneficial to be at a length or height greater than 10 feet is because the user transporting the balloon generally desires the balloon to be closer to their view so that they may enjoy its various shapes, and to also permit the projected squirting water to not evaporate or dissipate prior to reaching the height of their head, or near or to the ground surface. To maintain such utility of purpose, the balloon size need only be large enough to support a maximum 10 foot tube capable (with the necessary diameter) of transporting fluid along its length to the nozzle located near the balloon with sufficient force to squirt or spray from that nozzle or aperture. For these reasons, the length of the tube will most likely fall within the 1 to 10 foot length; and most commonly be 2 to 5 feet in height or length for most child sized and adult sized users whose heights generally fall within the 3 to 7 foot range. Additionally, shorter tube lengths may be required by regulation in crowded environments, but the play value would remain. The body weights of the users that fall within these heights are not a sufficient factor which would impede the operation of the disclosed device. The tube may be coupled to a stroller where even a smaller child could enjoy the play value of the device and not be affected by or affect in any way the buoyancy of the balloon and the successful operation of the liquid projection.

The subsequent tables list the minimum and maximum sizes that would be appropriate for the tubing. The maximum and minimum sizes give the resulting range of weight that the balloons must be capable of lifting. It is also likely that a tubing length and size somewhere in the middle of these ranges will be selected. Given the application of low pressure water transfer, most types of tubing will work for this application. A common tubing material used is PVC, but other materials can be used as well such as rubber (latex, silicone, Buna-N, EPDM, Neoprene), polyethylene, EVA, and polyurethane. These materials range in density approximately between 0.9 and 1.9 grams per cubic centimeters, but are most commonly around 1.2 grams per cubic centimeters.

Fluid Filled Tubing Sizes

| | Min | Max |
|---|---|---|
| Length [inches] | 12 | 120 |
| ID [inches] | 0.03125 | 0.1562 |
| OD [inches] | 0.09375 | 0.21875 |
| Density [g/cm^3] | 0.9 | 1.9 |
| Weight [pounds] | 0.022 | 0.25 |

The formula for the weight of the water filled tube is:

$$W_{total} = L * \frac{\pi}{4} * g * (((OD^2 - ID^2) * \rho_{tube}) + ((ID^2) * \rho_{water}))$$

Where $W_{total}$ is the total weight of the tubing with water inside of it, L is the length of the tube, g is the earth's gravitational acceleration, OD is the outside diameter of the tube, ID is the inside diameter of the tube, $\rho_{tube}$ is the density of the tube material and $\rho_{water}$ is the density of water.

The weight is what the balloon must lift, so the balloon must provide a lifting force of at least 0.022 pounds for the smallest tube, or up to 0.25 pounds for the largest tube.

The formula for the lift ability of a balloon is:

$$F_{lift} = \rho_{air} * g * V_{balloon} - \rho_{helium} * g * V_{balloon} - W_{load} - W_{balloon}$$

Where $F_{lift}$ is the lift ability of the balloon, $\rho_{air}$ is the density of air, g is the earth's gravitational acceleration, $V_{balloon}$ is the volume of the gas held in the balloon, $\rho_{helium}$ is the density of helium, $W_{load}$ is the weight the balloon is carrying such as the tubing, water in the tubing, and any other attachments, and $W_{balloon}$ is the weight of the balloon skin material.

| Type | Inflated Diameter [inches] | Lift Ability [pounds] | Gas Capacity [cubic inches] |
|---|---|---|---|
| Latex | 5 | 0.000 | 104 |
| Latex | 9 | 0.013 | 432 |
| Latex | 11 | 0.022 | 864 |
| Latex | 16 | 0.075 | 2592 |
| Latex | 18 | 0.113 | 3456 |
| Latex | 24 | 0.250 | 8640 |
| Mylar | 13.5 | 0.006 | 864 |
| Mylar | 24 | 0.094 | 2765 |
| Mylar | 27 | 0.144 | 7603 |

This table shows that a 24 inch latex balloon is capable of lifting the designated max weight of 0.2 pounds. The other balloons could lift lighter tube configurations (shorter or smaller diameter), or multiple balloons would be needed to generate the lift.

For the pressure required to squirt the water, it has been found that the water exit velocity ideally is approximately 1 foot per second. Where the pump mechanism is located at the bottom or most distant location from the nozzle, of the tubing, the pump must generate between 0.4 to 5.2 psi gauge pressure to as high as 10 psi gauge pressure.

In an unrelated method of water play, it has been well know that decorative balloons as the type described herein, can be filled with water to create a "water balloon" for throwing and exploding on impact for the purpose of water play, although such use was not part of the original design purpose of such balloons which were originally and primarily designed to contain only a gas, not a liquid. In other unrelated art for play and games, water play has been introduced in the past and present via squirt guns and the like that are commonly used to discharge water for play. The instant art is none of these, but rather a novel way of enjoying a balloon in conjunction with water in an entirely new way, which adds to the enjoyment, fun and decoration, not currently available in any existing or prior art.

The instant apparatus comprises a balloon attached to an extended holding or retention device such as a string, rope, elastic and flexible tube, or spring wire or other type of flexible but more rigid, support), or a combination of a flexible tube connected or woven or interlaced with a flexible but supportive and more rigid member, while still allowing the balloon to move about from side to side; being either a solid rope or string with an adjacent tube for transporting water through the tube from a reservoir to the balloon. The support wire may be made of metal like sprig wire, which is thin and more closely resembles a string or the like in appearance; or it can be made of any plastic or natural material such as bamboo or other thin, flexible material that performs the same or similar function. Or, the rope or string holding the balloon may also double as a hollow tube or elongated opening or conduit which transports liquid through it.

The balloon is designed such that the water may be transmitted through the gas filled portion of the balloon in some fashion via an internal liquid transport means (such as a thin tube), and where it exists from an aperture at one or more locations on the balloons' external surface. Or, the hollow tube or conduit and rigid support rope or member may be directly adjacent to or coupled together.

In another embodiment, a liquid (or gas) reservoir is directly adjacent or beneath the air filled portion of the balloon, where the release of liquid is operable by a person's hand located at the end of a rope or string or rigid support member holding the balloon away from the individual. "Adjacent" here is defined as a distance within 6 inches of the balloon. The size of the reservoir is generally limited to the maximum span of a human hand and dictated by the anticipated end user. Different sized reservoirs can be available depending on whether the user is a child with a hand span (defined elsewhere in this disclosure) less than 4 inches from thumb to baby finger when the hand is extended in its maximum open position. Or, for an adult user, the hand span can be as great as 12 inches. Thus the general width or cross section of the reservoir will be less than 7 inches. In such an embodiment, the balloon has no aperture for the release of water, but it supports the reservoir or it supports the release aperture adjacent to it. In other embodiments, the reservoir may be contained within the balloon itself, but is still operable from where a person is holding the end of the rope or string or rigid holding member. But, these last embodiments, when containing liquid, can be less preferred due to the weight of a liquid being adjacent to the balloon. This can be offset by the introduction of gas or compressed air to the device. If no gas is involved, it can be more preferable to place the liquid reservoir such that it does not impede the buoyancy of the balloon. For example, the reservoir is located adjacent or near the body or hand of a person holding the string ("string" includes in its definition all other described types such as rope, wire, rod, etc.) so that the reservoir may be filled and refilled without recalling the balloon, and while allowing it to continue to float.

"Near the body or hand" is defined as the reservoir being either adjacent to a hand that may hold the string; or where a part of the hand is in contact with the reservoir such that the hand is at least partially supporting the weight of the reservoir; or where the reservoir is located in close proximity to the body such that the weight of the reservoir does not impede the buoyancy of the balloon. For example, a person may be holding the reservoir directly where the reservoir is configured to be held by a human hand spanning a size of 3 to 12 inches when the fingers and thumb are open and outstretched to their maximum extension. Or, the reservoir may be strapped or otherwise coupled to the hand so that the user may grasp other items. For example the reservoir could be attached to the back of a user's hand. By holding the reservoir adjacent or in a hand clasp in the various manners described, the balloon buoyancy is less impeded. Close proximity to the body defines a distance within the maximum extension of a person's arm reach regardless of their size. A small child with have a smaller reach than a large adult, but the reservoir is within their respective arm extensions or reach. So, in another example, the reservoir could be attached to a person's body or clothing within their reach distance such that the body at least partially supports the weight of the reservoir with or without fluid. This configuration would also reduce or completely remove almost all of the liquid weight affecting buoyancy of the balloon, except for the smaller amount flowing through and along the tube or tubes to the nozzle located at or near the floating balloon.

In still other embodiments, the release aperture may be adjacent to the balloon or otherwise attached to it, and not emanating from the sphere of the balloon polygon. For example, a rotating liquid release nozzle or nozzles (apertures) could spin or rotate beneath or adjacent to the gas filled balloon in a manner similar to a rotating sprinkler head. Or one or more apertures could make the balloon spin as well. The result is a new way to enjoy a gas filled balloon with water play in a way not previously accomplished.

Playful shapes can be introduced to enhance enjoyment of the device. For example, a round balloon could have nozzles imitating a cow's teats, either pointing up or down or sideways, or any other direction, where one or more of the teats squirts water. Other playful options are possible. For example, a balloon shaped like an airplane may have an aperture resembling a gun port in order to shoot liquid or water so as to resemble a plane shooting like a World War II fighter. Other silly or playful options are available such as the forming a balloon to look like a water fountain known as a "manneken pis" statue fountain (historically a statue fountain where water releases through a human phallus). A gas filled balloon can be shaped to resemble such a statue fountain and attached to a string, rope or semi rigid or highly flexible tube where water is transmitted out through its aperture to imitate this well-known statue. While such a balloon would not be something one would use at a child's party perhaps, it would be suitable for other venues and celebrations, art shows and the like, adding to the humor and fun for those occasions. The water reservoir could be situated in any manner previously discussed.

The control for the discharge of water from or adjacent to these balloons would be operable by a person's hand holding a handle that both supports the attached string rope or tube whether rigid or flexible; and serves to operate the liquid through a hollow tube on through the balloon's aperture for the release of the liquid. While the operation in more simple applications would generally be operated by the hand as in a hand manually squeezing the reservoir. Or the user may manipulate the handle so that a more distant reservoir releases the liquid, it could also be mechanically or electrically operated so that the hand would not have to physically squeeze or otherwise physically push the liquid through the tube. In another aspect, the reservoir itself is sufficiently malleable such that the manual squeezing by a user's hand provides sufficient force to transport the fluid through the tube towards the balloon and nozzle for projection out of the nozzle. Arrangements are described wherein the liquid is retained at least partially within the balloon itself or in a separate liquid-containing chamber attached to the ball, or wherein the liquid is supplied to the ball under pressure via a tube.

Several illustrated aspects of the disclosed play apparatus include one or more water reservoirs in fluid communication with one or more squirt nozzles. The one or more nozzles are disposed on the surface of the ball, on an outwardly facing portion of the handles, or on another type of outward extension. The squirt nozzles are activated by a user or person via hand manipulation, and may pump or squirt water in one of several manners, which may or may not be shown in the drawings but are known. For example, the fluid can be pressurized and each time a trigger is depressed the pressurized fluid squirts out a nozzle. Alternatively, depressing the trigger can simultaneously pressurize and release fluid through a nozzle. These are, however, merely examples, and other methods of squirting liquid from squirt nozzles are described below with respect to balloon play described herein. Appropriate squirting and liquid pumping mechanisms are shown in WO/2007/027647, U.S. Pat. Nos. 7,938,758, and 8,915,826, which are incorporated herein by reference in their entireties. The fluid can be pressurized and each time a trigger is depressed the pressurized fluid squirts out a nozzle. Alter natively, depressing the trigger can simultaneously pressurize and release fluid through a nozzle.

These are, however, merely representative examples, and other methods of squirting liquid from squirt nozzles are available. For example, the apparatus may utilize a peristaltic pump. A user turns a hand crank to operate the peristaltic pump and pump liquid from the reservoir. The outlet of the peristaltic pump squirts liquid through the nozzle. Another example of the play apparatus is where the balloon includes a reservoir externally positioned adjacent to or on the balloon. A flexible tube contains two passageways (not shown) that separately are in fluid communication between a pump unit and the reservoir. By activating a pump handle, a user is able to deliver pressurized air to the reservoir via one of the passageways. When a trigger is activated by a user, the pressurized air forces liquid to flow from the reservoir, through the second passageway, through the barrel of the pump unit and out through the nozzle.

Another pump mechanism may be a syringe-type pump, or a piston-type pump where the user moves a handle to operate a piston and pressurize a reservoir, then activates a triggering mechanism (such as a gun trigger type design or the like for example) to squirt the liquid. A reservoir 600 is attached to a ball 602 via a clevis assembly comprising an upward extending eye projection, such as a lug 604, and a clevis pin 606, which may comprise a machine screw and cap nut. A non-squirting handle 608 extends from the reservoir assembly. Also extending from the reservoir assembly is a squirting handle. The squirting handle is attached to the reservoir assembly and a pump piston by a shaft which passes through an opening defined by a shaft support member. A helical compression spring surrounds the shaft or the like and is between the piston and a wall of the reservoir. A spring is compressed as the user pulls upwardly on the squirting handle. As the pump piston moves upwardly, the volume of the pump chamber is reduced and pressurized air is pushed through a one way valve into a tube and deposited into the reservoir. A tube can then allow ambient air pressure to vent into the lower portion of the pump chamber in order to prevent a vacuum from developing during the movement of the piston. When the user is no longer pulling upwardly, the pump piston is at increased pressure in the reservoir. The diameter of the pump piston 612 is selected so that a minimal stroke length will result in adequate pressurization of the reservoir between 0.4 to 10 psi in a minimal number of strokes. Minimizing the stroke length reduces the movement of the squirting handle relative to the balloon. The spring should be selected so that the force required for the user to move the pump does not exceed the strength of either the child or adult user for which the disclosed apparatus is designed. Alternate arrangements may include a double acting pump mechanism that uses springs to push a piston toward a center position and thus pump pressurized air into the reservoir when the piston is moved either upwardly or downwardly.

BRIEF DESCRIPTION OF THE DRAWINGS

The accompanying drawings, incorporated in and forming a part of the specification, illustrate several arrangements.

In the drawings.

DETAILED DESCRIPTION

Referring to FIGS. 1A through 9B, there is illustrated therein a new and improved method of balloon water play previously summarized.

While the apparatus has been described in connection with a preferred embodiment or embodiments, it is not intended to limit the scope of the apparatus to the particular form set forth, but on the contrary, it is intended to cover such alternatives, modifications, and equivalents as may be within the spirit and scope of the apparatus as defined by the listed claims.

Figure 1A:
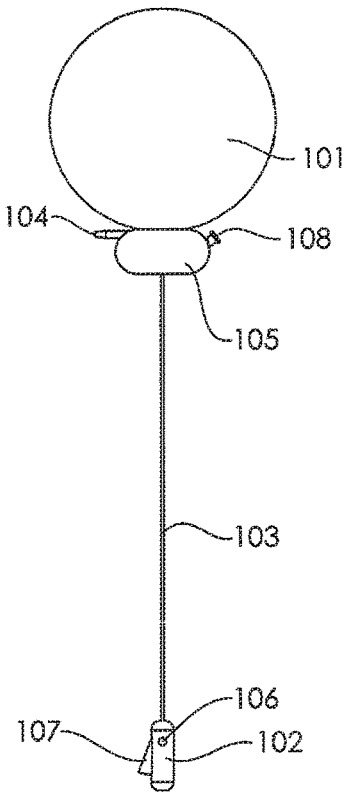
FIG. 1A is a side view of a rod-supported squirting balloon with an external reservoir operable either manually, powered to transport liquid or air.

FIG. 1A is a rod-supported squirting balloon comprising of an inflated balloon, 101, a handle, 102, a connector that is a rod, 103. A mechanism is provided to cause liquid to be expelled from the apparatus. The mechanism includes a nozzle, 104, having an orifice, a water reservoir, 105, that defines a reservoir chamber that contains a body of water, a trigger button, 106, a pump lever, 107, and a reservoir fill inlet, 108. The orifice is in fluid communication with the reservoir so that water in the reservoir can be pumped through the orifice. The mechanism, including the trigger button, 106, and the pump lever, 107, is manipulatable by the user to control the flow of liquid from the reservoir chamber to the orifice.

In the apparatus of FIG. 1A, the reservoir is located adjacent to the balloon. In particular, the reservoir touches the balloon. The reservoir can be coupled to the balloon in various ways, advantageously by Velcro hook and loop fastener material (not shown) attached to a surface of the reservoir and to a facing surface of the balloon respectively.

Creating a squirting balloon is a difficult task because water is heavy and balloons need to be light to float. The arrangement of FIG. 1A solves the problem by supporting the balloon, 101, above the ground with a substantially rigid connector, in particular, a rod, 103. The rod, 103, can be sized so that it is lightweight and flexible. The rod, 103, provides support for the balloon but it can also move around like a floating balloon. The rod, 103, could be made out of spring steel, fiberglass, plastic or any other material that is strong and flexible enough to serve this purpose. This also means that the balloon, 101, doesn't have to be filled with helium which is expensive and doesn't last long. The water can be stored in a reservoir, 104, at the top of the pole, 103, as shown, or it could be located remotely and connected with a tube. The water reservoir, 104, could also be mounted directly to the bottom of the handle, 102. If the water is located at the top of the rod, 103, it doesn't have to be pumped up, but the downside is it is a heavy thing to hold and requires a stronger rod, 103. Having the water located below requires it to be pumped up to the nozzle, 104, but it is easier to carry. The handle, 102, can also be a powered device that transports the liquid or air by battery power or other power source such that physical squeezing by a hand is not required to move the medium through the tube and/or string support.

Figure 1B:
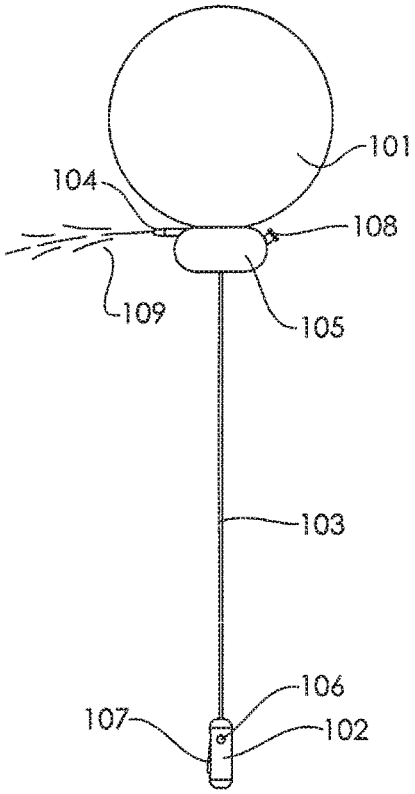
FIG. 1B is a side view of a rod-supported squirting balloon with an external reservoir with the pump lever depressed.
Figure 1C:
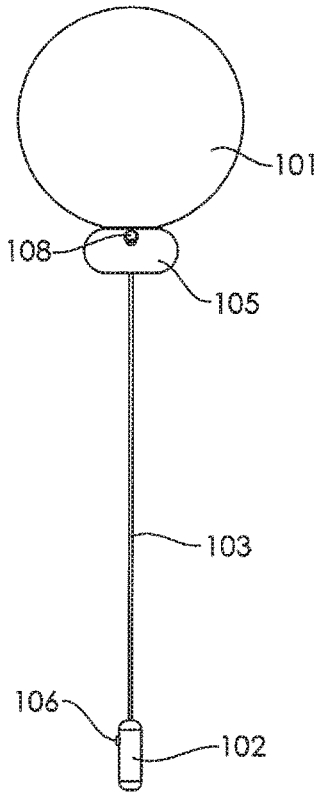
FIG. 1C is a rear view of a rod-supported squirting balloon with an external reservoir.
Figure 1D:
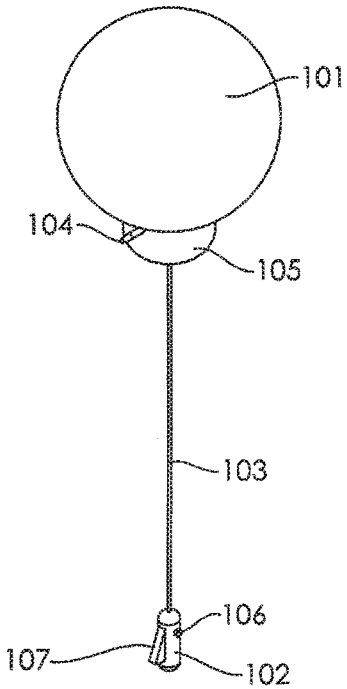
FIG. 1D is an isometric view of a rod-supported squirting balloon with an external reservoir.

FIG. 1B shows the pump lever, 107, is depressed. The user can repeatedly squeeze the pump lever, 107, to build up pressure for firing the water by pushing the trigger button, 106, which emits or projects the liquid, 109 radially relative to the connector. Alternatively, the system could be pressurized by the hose pressure when it is being filled. The reservoir fill inlet 108 could a hole for pouring water in, or it could be a quick release fitting for a pressurized fill of a fluid-tight reservoir. Another way to pressurize the water would be by the use of one or more electric pumps. In such an arrangement, the handle, 102, contains batteries, and the trigger button, 106, would activate the electric pump or pumps when pressed. In the configuration using an electric pump, the hand pump lever, 107, would not be needed.

Figure 2A:
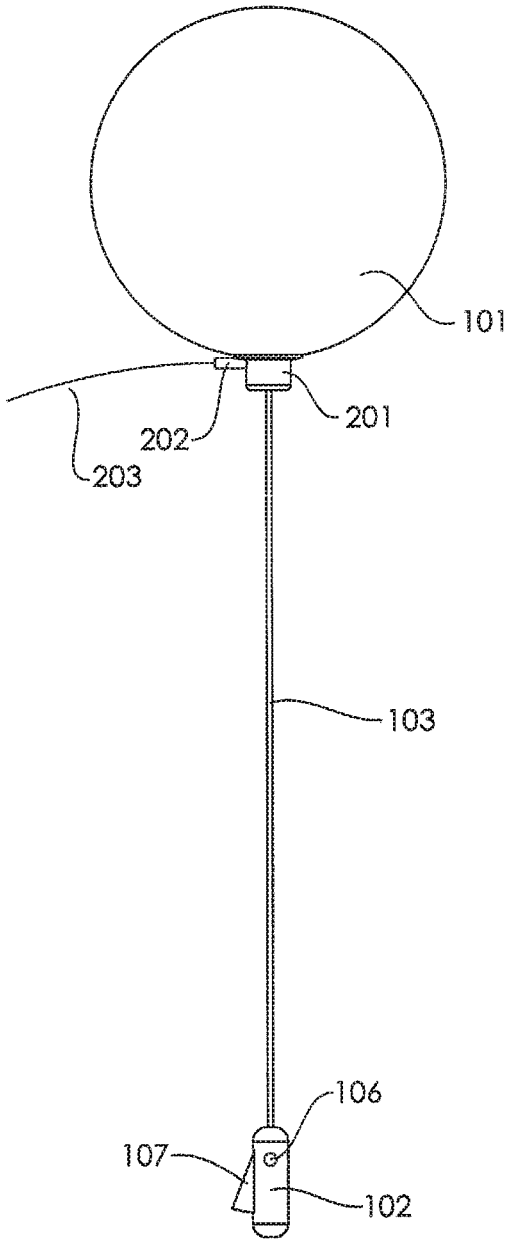
FIG. 2A is a side view of a rod-supported squirting balloon with a gas or liquid reservoir inside the balloon.
Figure 2B:
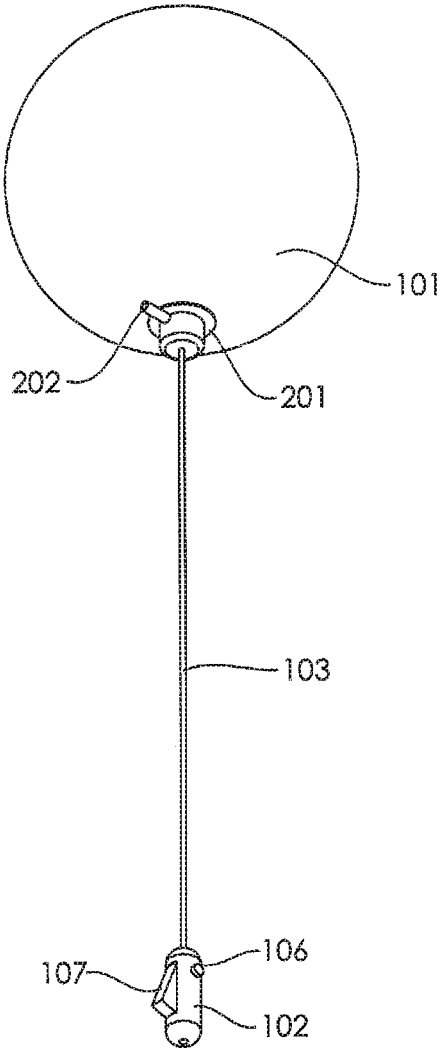
FIG. 2B is a lower isometric view of a rod-supported squirting balloon with a reservoir inside the balloon.

FIGS. 2A and 2B show a variation of the rod-supported apparatus shown in FIG. 1. In the apparatus of FIGS. 2A and 2B, the balloon, 101, comprises a containment wall that defines a balloon chamber, which chamber contains inflation gas. The water reservoir is located inside the balloon chamber (not visible). In other arrangements, a portion of a reservoir may be located inside a balloon chamber. The nozzle, 202, projects the liquid, 203. This utilizes the space available and results in a cleaner look showing only the balloon polygon. As illustrated, the nozzle, 202, has an orifice positioned to direct a stream of water to a location distant from the balloon. In particular, the orifice is at a sufficient elevation and oriented such that the stream of water extends sufficiently horizontally that water squirted from the apparatus does not fall onto a user standing under the balloon and holding the handle, 102.

Figure 3A:
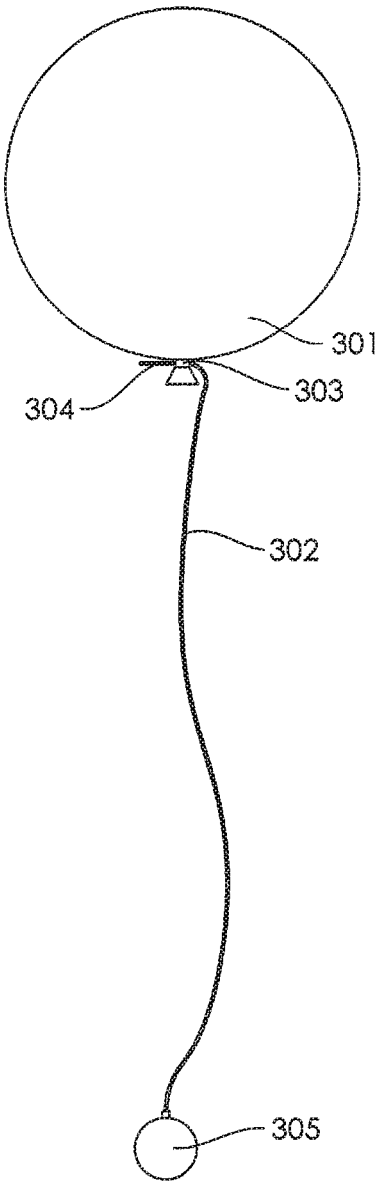
FIG. 3A is a side view of a squirting balloon with a squeeze pump.
Figure 3B:
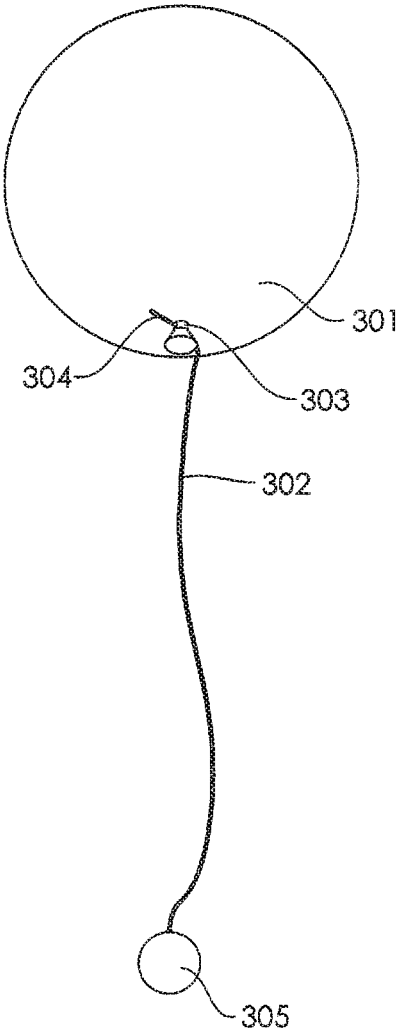
FIG. 3B is a lower isometric view of a squirting balloon with a squeeze pump.

FIGS. 3A and 3B shows a squirting balloon apparatus comprised of a balloon, 301, and a connector that is attached to the balloon for holding the balloon at a location above the ground. In the arrangement of FIG. 3A-3B, the connector is a flexible and small diameter tube, 302, that defines a passageway to contain a flow of water. All or only a portion of a tube could serve as the connector that holds the balloon in position. The illustrated apparatus also has a tube attachment fitting, 303, a nozzle, 304, and a squeeze pump, 305. The connector is secured at an attachment location that is remote from the balloon, which attachment location is at the squeeze pump, 305, in the particular apparatus of FIGS. 3A and 3B. The balloon, 301, in this embodiment is a lighter than air gas, such as helium-filled balloon, so it floats. The balloon is sufficiently buoyant to overcome the weight of the connector and suspend the connector, in particular the tube, 302, which therefore extends generally vertically above the ground. The squeeze pump, 305, is the reservoir where the water is stored and it is held by the user, the balloon being located above the reservoir. The nozzle, 304, has an orifice that is located above the reservoir and is in fluid communication with the passageway. The squeeze pump/reservoir, 305, has a wall that defines the reservoir chamber. At least a portion of the wall is movable such that a person can control the flow of liquid by manually squeezing the squeeze pump/reservoir When released, the squeeze pump, 305, acts as a weight and keeps the balloon, 301, from flying or otherwise releasing away. The squeeze pump, 305, is flexible, and when squeezed, its volume is reduced which forces water through the tube, 302, and out the nozzle, 304. The squeeze pump, 305, can be refilled by sucking water in from the nozzle, 304, or there can be a fill cap attached to the squeeze pump, 305.

And, while the instant embodiment shows a manual activation with a hand, nothing limits reservoir release to only manual means. Other means such as mechanical or electrical or other non manual manipulation may also be utilized. This configuration only allows for a few of shots of water at a time, but the benefit is that it is light enough to float on its own when filled with a lighter-than-air gas such as helium.

FIGS. 3A and 3B show a tube, 302, that is curved because it is made out of a flexible tube material. When the user pumps water into the tube, 302, the water pressure stresses the tube material and straightens it. This straightening of the tube, 302, aligns the length of the tube, 302, vertically which raises the height of the balloon, 301, as a result. This allows the user to raise and lower the balloon, 301, by pumping water. In other words, the mechanism is operative to increase the pressure of fluid within the passageway and thereby rigidify and straighten the tube and cause the balloon to move away from the attachment location.

Figure 4A:
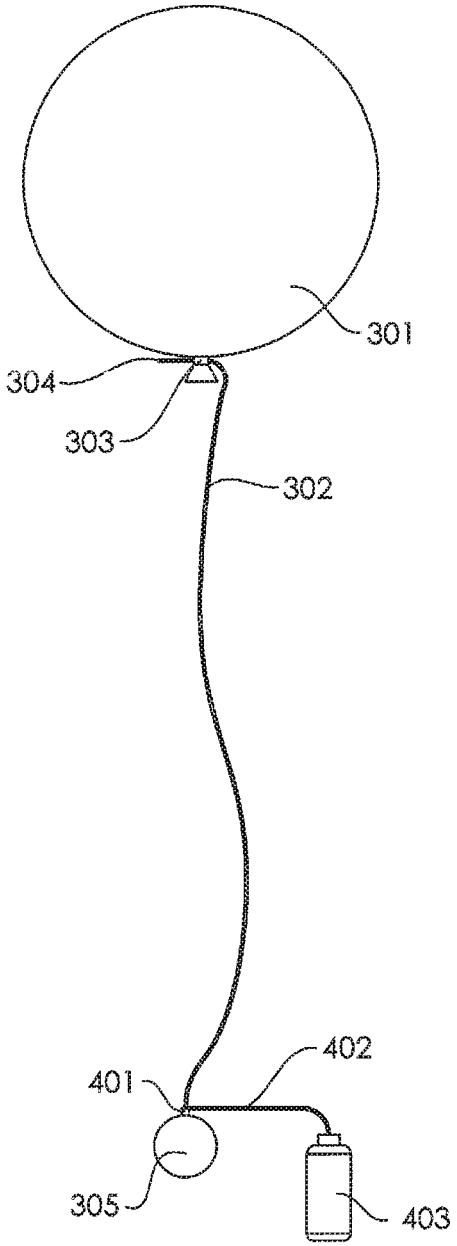
FIG. 4A is a side view of a squirting balloon with a squeeze pump and an external reservoir closer to the pump than the balloon.
Figure 4B:
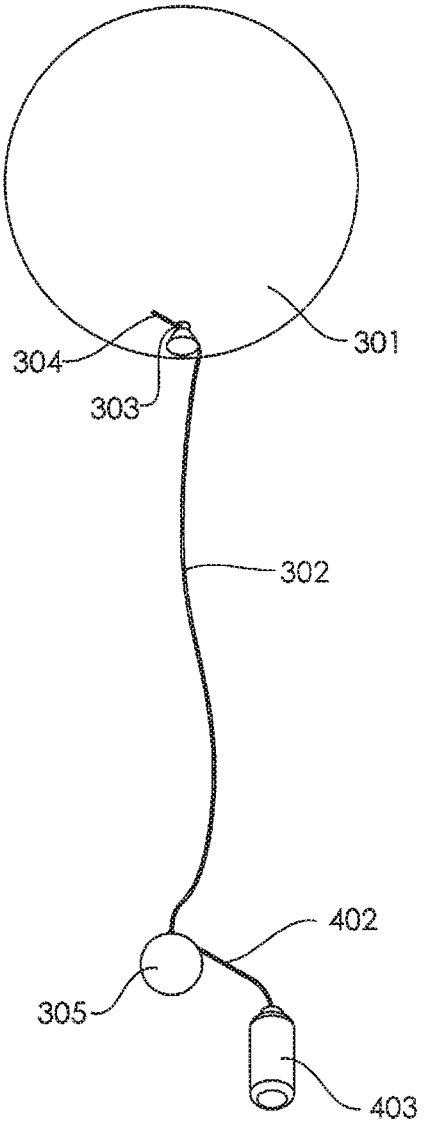
FIG. 4B is a lower isometric view of a squirting balloon with a squeeze pump and an external reservoir.

FIGS. 4A and 4B is an embodiment similar to the squeeze pump balloon shown in FIG. 3, but the apparatus of FIGS. 4A and 4B has an additional external water reservoir, 403, that is located at a distance from the balloon. There is an extension tube, 402, which connects the external water reservoir, 403, to a fitting, 401. The fitting, 401, has check valves which only allow the water to flow towards the nozzle. For example, it can be a T fitting or other method witch accomplishes the same thing. When the squeeze pump, 305, is squeezed, it pushes water through the T fitting, 401, and to the tube, 302. When the squeeze pump, 305, is released, it sucks water in from the external reservoir, 403, through the T fitting, 401. The external water reservoir, 403, can be worn by the user. For example, it can be clipped to their belt. This allows for the reservoir to be a larger size and therefore can carry a greater amount of water, but only the light weight tube, 302, needs to be suspended by the gas filled balloon, 301, so it will still float on its own. Although not shown, the reservoir can be supported via a backpack configuration, or otherwise attached to the user. The water reservoir, 403, can be a bottle or bladder that unscrews from the extension tube, 402, so it can easily be filled with unpressurized water. This also permits a larger reservoir. The reservoir, 403, can be attached anywhere on a person via an arm strap, hip or belt or leg connection, or backpack. This embodiment could also be combined with the rod "string" supported squirting balloons shown in FIGS. 1 and 2, where it uses a support rod instead of the water tube, 302. In that case, it would use a hand pump or electric pump instead of the squeeze pump, 305, shown.

Another arrangement would include a mechanism whereby the user exerts pressure on a handle to squirt liquid. In the illustrated apparatus of FIG. 4*a*, the tube, 302, defines a passageway to contain a flow of water. A user squeezes pump 305 and releases it to draw liquid from a reservoir 403 with an inner one way valve and into the pump. Squeezing the pump a second time forces liquid contained therein through an outer one way valve, through the passageway, and out of the nozzle 304; the pump then refills when the pump is released by the user.

Figure 5A:
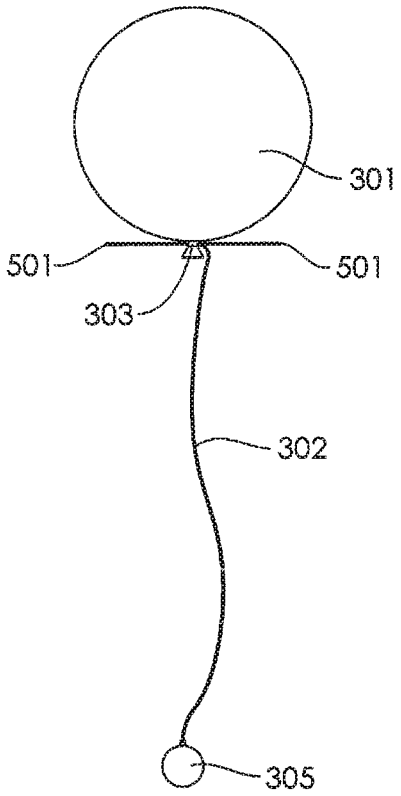
FIG. 5A is a side view of a rotating squirting balloon.

FIG. 5A shows a squirting balloon with offset nozzles, 501.

Figure 5B:
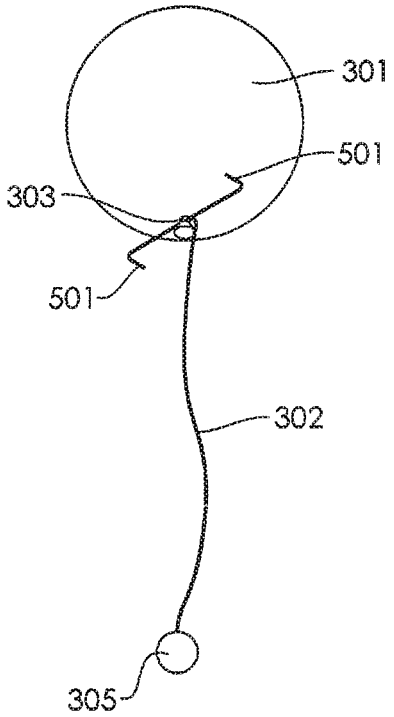
FIG. 5B is a lower isometric view of a rotating squirting balloon.

FIG. 5B shows that there are two offset nozzles, 501, and they are pointed in opposite directions. When the balloon squirts, and water is shot out of the two nozzles, 501, this creates a force couple which causes the balloon, 301, to spin in place. It should be appreciated that the number and placement of the nozzles can be in any configuration or height in relation to each other.

Figure 5C:
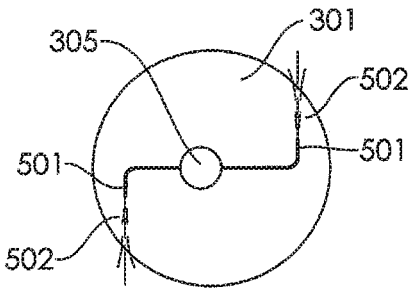
FIG. 5C is a bottom view of a rotating squirting balloon.
Figure 5D:
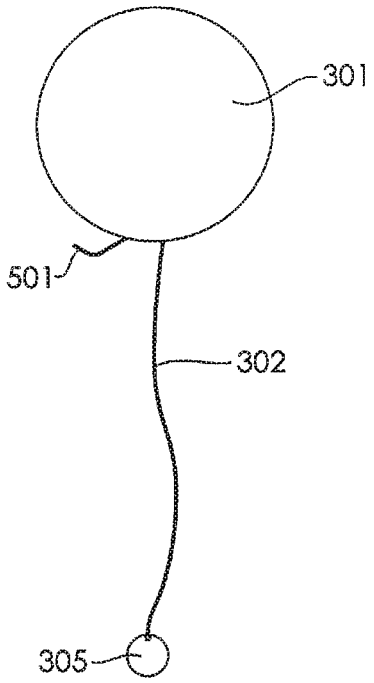
FIG. 5D is an upper isometric view of a rotating squirting balloon.

FIG. 5C is a bottom view that shows the nozzles, 501, are pointing 180 degrees apart, and projecting a liquid, 502. The angle and the offset distance from the center of the balloon, 301, could be changed to change the spinning performance of the balloon, 301. The farther out from the center of the balloon, 301, the nozzles are, 501, the more spinning torque will be generated for the same water flow. FIG. 5D is another orientation wherein only one of the nozzles are visible.

Figure 5E:
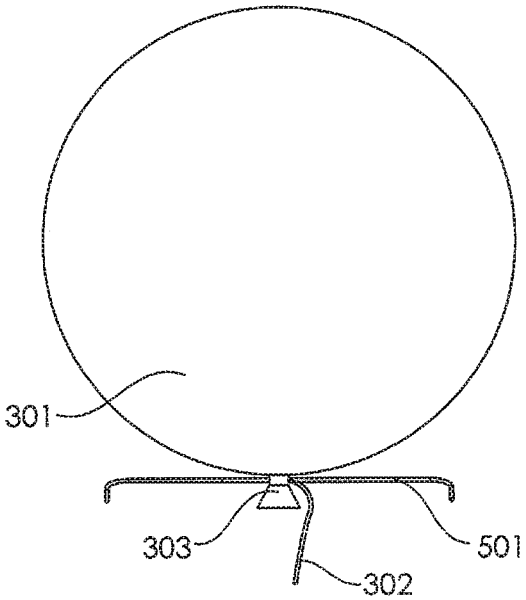
FIG. 5E is a side view of a rotating squirting balloon with downward angled nozzles.
Figure 5F:
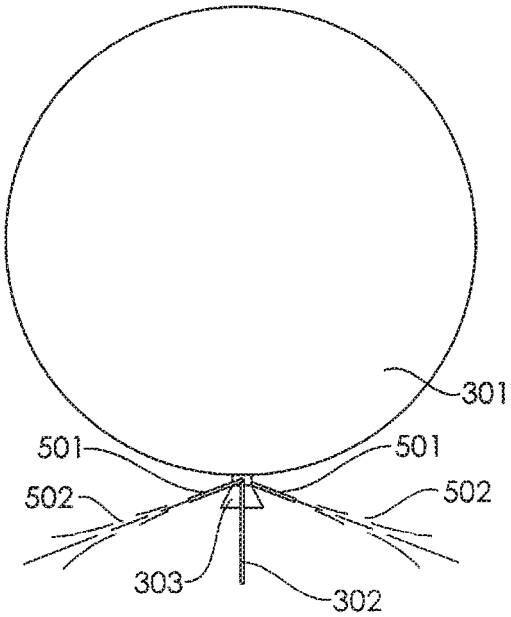
FIG. 5F is a front view of a rotating squirting balloon with downward angled nozzles.
Figure 5G:
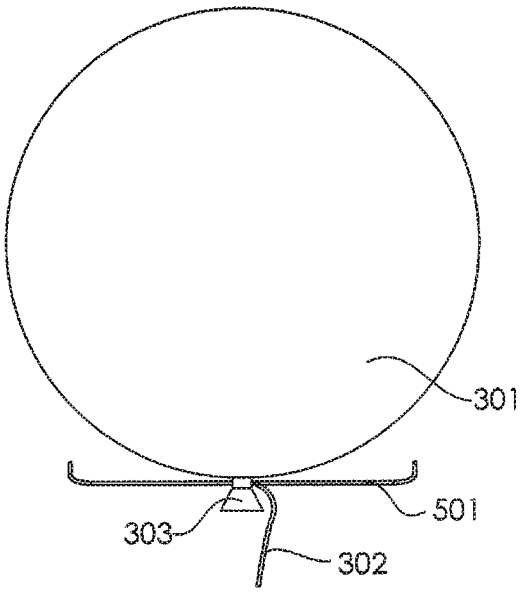
FIG. 5G is a side view of a rotating squirting balloon with upward angled nozzles.

FIG. 5E is a side view showing the eccentric water nozzles, 501, that are angled downward. This downward angle causes the balloon to spin and also rise. FIG. 5F is a front view showing the eccentric water nozzles, 501, that are angled downward, projecting a liquid, 502. It should be appreciated that the size and width of the stream of liquid may differ wherever liquid projection is shown in the drawings, and the stream shown in 502 and elsewhere is shown as one of many examples of the types of streams that can be projected from the disclosed device. The nozzles, 501, are still oriented 180 degrees apart, but they also have a downward tilt. A force couple still exists which creates torque around the balloon, but there is also a force pushing the balloon up. FIG. 5G is a side view showing the eccentric water nozzles, 501, that are angled upward, with a liquid stream also projecting upward, 5H, 502.

Figure 5H:
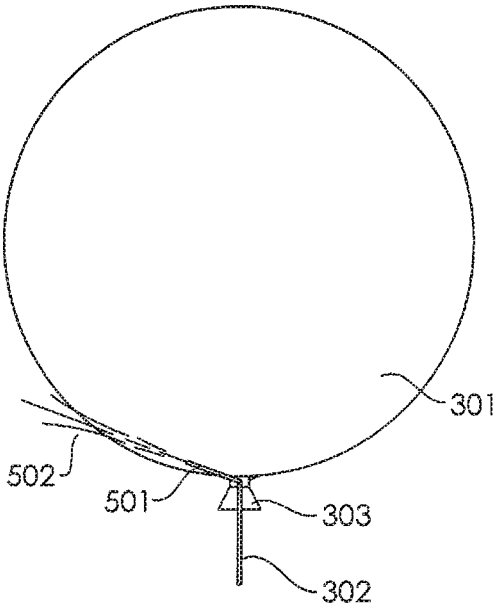
FIG. 5H is a front view of a rotating squirting balloon with upward angled nozzles.

This upward angle causes the balloon to spin and also sink. FIG. 5H is a front view showing the eccentric water nozzles, 501, that are angled upward. The nozzles, 501, are still oriented 180 degrees apart, but they also have an upward tilt. A force couple still exists which creates torque around the balloon, but there is also a force pushing the balloon down. The nozzle angles could be adjusted to achieve whatever angle is desired. They can be adjusted remotely so the user can control the angle to maneuver the balloon as they desire.

Figure 6A:
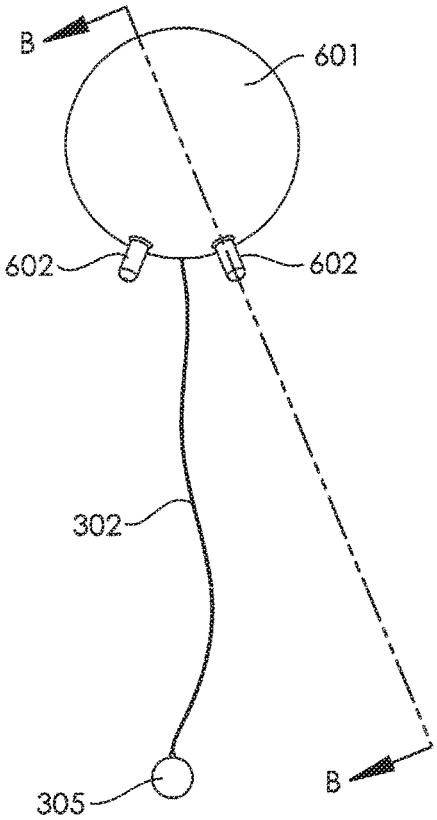
FIG. 6A is a side view of a squirting udder balloon.

FIG. 6A shows a squirting balloon stylized after a cow udder. It is shown using the squeeze pump, 305, design, but it would also work with any other pumping method. It is comprised of an udder balloon, 601, with four protruding teats, 602.

Figure 6B:
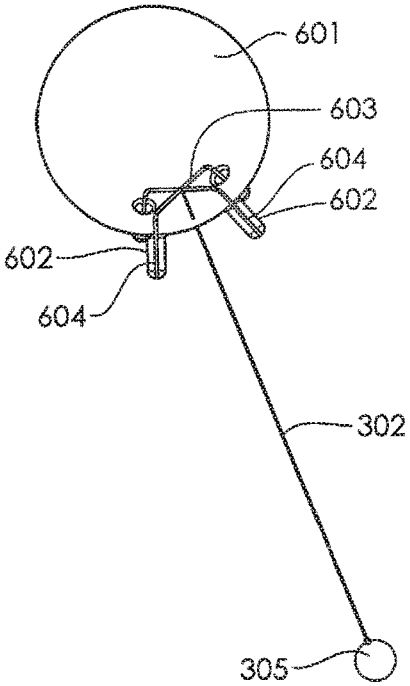
FIG. 6B is an angled section view of a squirting udder balloon.
Figure 6C:
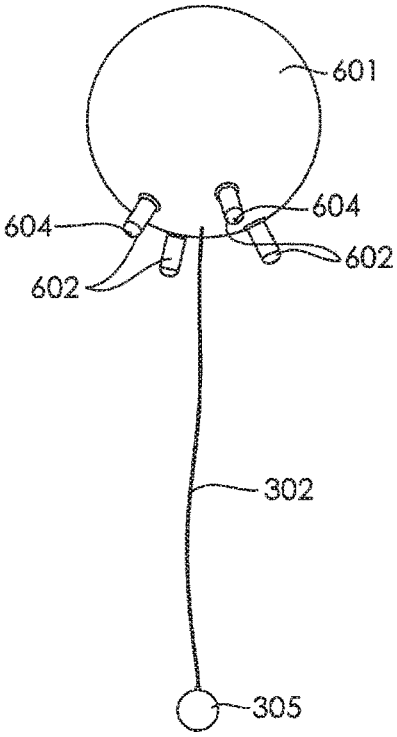
FIG. 6C is a lower view of a squirting udder balloon.
Figure 6D:
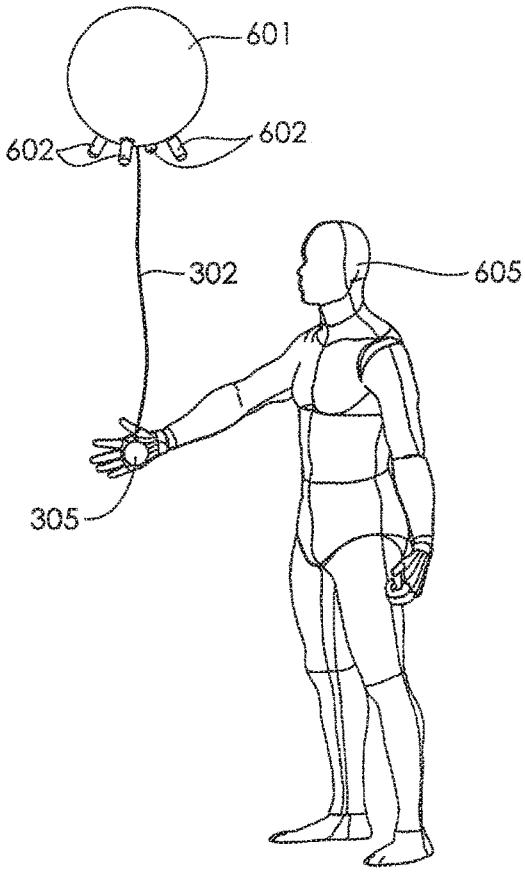
FIG. 6D is an angled view of a person holding a squirting udder balloon.

FIG. 6B is an angled section view that cuts through two of the teats, 602, and shows the inside of the udder balloon, 601. This configuration shows that the water tube, 302, goes into the udder balloon, 601, and branches off into four teat tubes, 603. These go through the teat protrusions, 602, and lead to the teat nozzles, 604. It is also possible to have any number of the teats actually squirt, such as just one, or only the front two. FIG. 6C shows a squeeze pump attached to the udder balloon. FIG. 6D shows a person, 605, holding onto the squeeze pump, 305, and the udder balloon, 601, is floating.

Additionally, the tubes feeding the teats need not go through the balloon, but can be run along the surface of the balloon to the teat apertures.

Figure 7A:
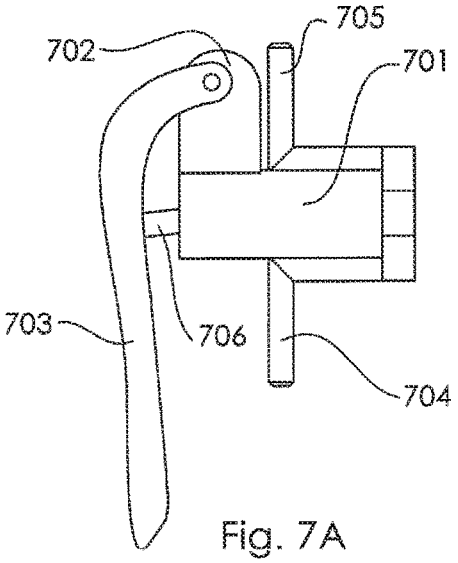
FIG. 7A is a side view of a hand piston pump.
Figure 7B:
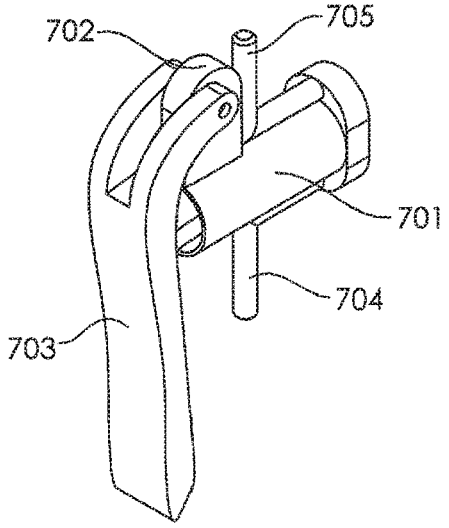
FIG. 7B is an upper isometric view of a hand piston pump.
Figure 7C:
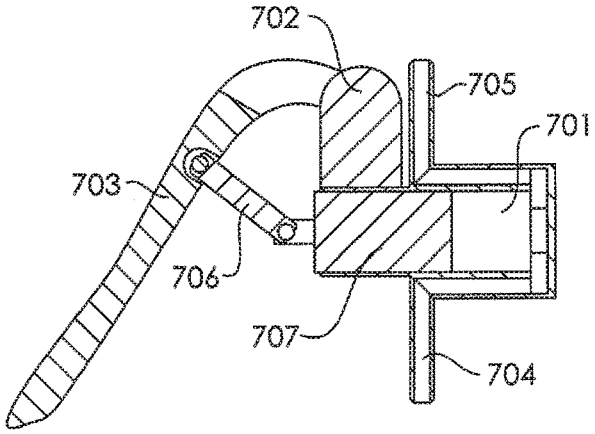
FIG. 7C is a side cross section view of a hand piston pump in the pull position.

FIG. 7A is a side view of a hand piston pump comprising of a cylinder, 701, a handle attachment, 702, a handle lever, 703, an inlet tube, 704, an outlet tube, 705, and an arm, 706. This pump is used to pump water to the balloon. The inlet, 704, has a check valve which only lets water in, and the outlet, 705, has a check valve that only lets water out. FIG. 7B is an isometric view of the hand pump. FIG. 7C is a side cross section view showing the hand pump in the pull position. This position pulls the piston, 707, outward and sucks water into the cylinder, 701, from the inlet, 704.

Figure 7D:
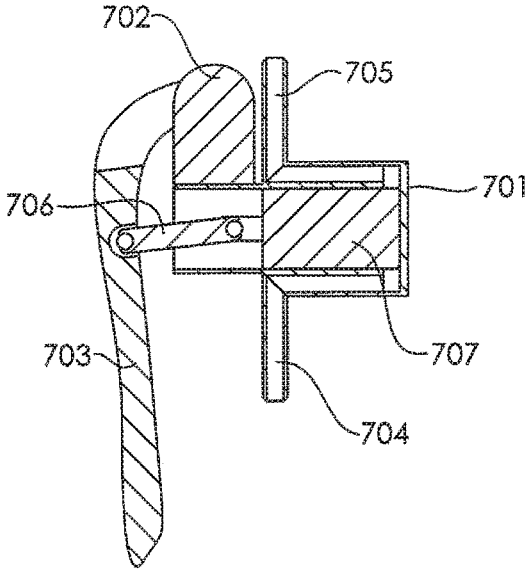
FIG. 7D is a side cross section view of a hand piston pump in the push position.

FIG. 7D is a side cross section view showing the hand pump in the push position. This position pushes the piston, 707, into the cylinder, 701, which force water out through the outlet, 705.

Figure 8A:
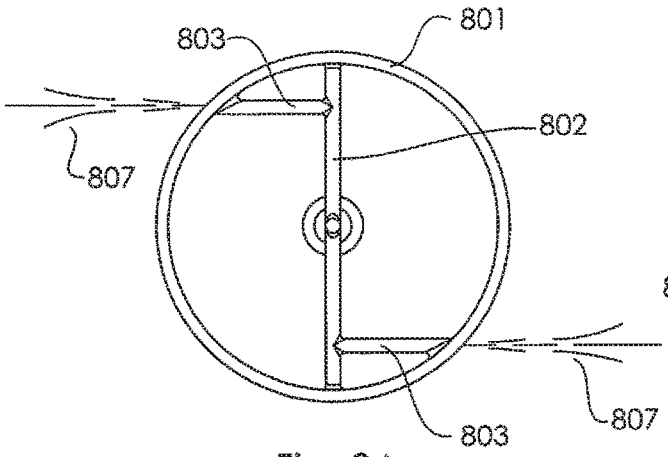
FIG. 8A is a top view of a spinning disc assembly.

FIG. 8A shows a spinning disc assembly comprising of a ring, 801, a cross tube, 802, and offset tubes, 803, with a liquid projecting from two locations on the ring, 807. The ring, 801, provides rigidity for the extended tubes. The offset tubes, 803, are positioned eccentrically from the center of the disc to create a force couple when water squirts out of the tubes.

Figure 8B:
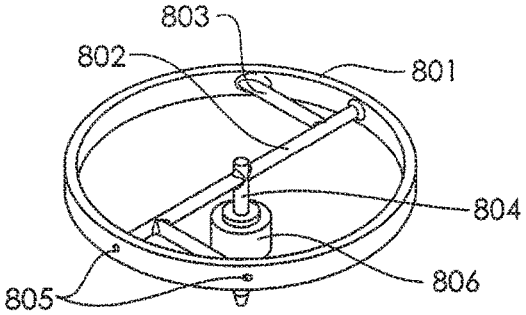
FIG. 8B is an isometric view of a spinning disc assembly.
Figure 8C:
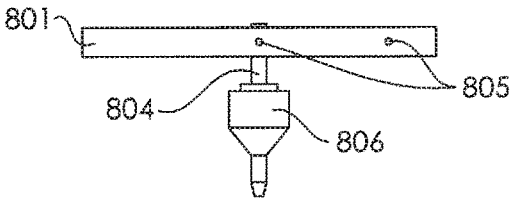
FIG. 8C is a front view of a spinning disc assembly.
Figure 8D:
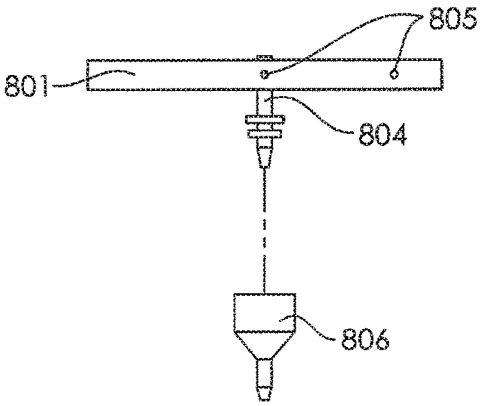
FIG. 8D is a front exploded view of a spinning disc assembly.
Figure 8E:
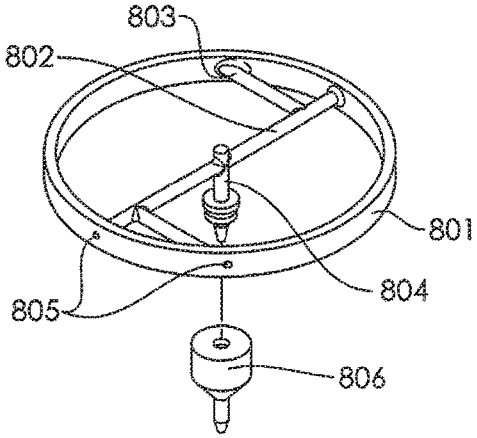
FIG. 8E is an isometric exploded view of a spinning disc assembly.

FIG. 8B is an isometric view of a spinning disc assembly. This view shows the outlet holes, 805, positioned on the disc, 801. It also shows the inlet bushing, 806, and the inlet stem, 804. FIG. 8C is a front view of a spinning disc assembly. FIG. 8D is a front exploded view of a spinning disc assembly. This shows that the inlet bushing, 806, is a separate part that snaps onto the inlet stem, 804. This bushing, 806, allows the disc, 801, to spin freely without tangling the water tube which will attach to the inlet bushing, 806. FIG. 8E is an exploded isometric view of a spinning disc assembly.

Figure 9A:
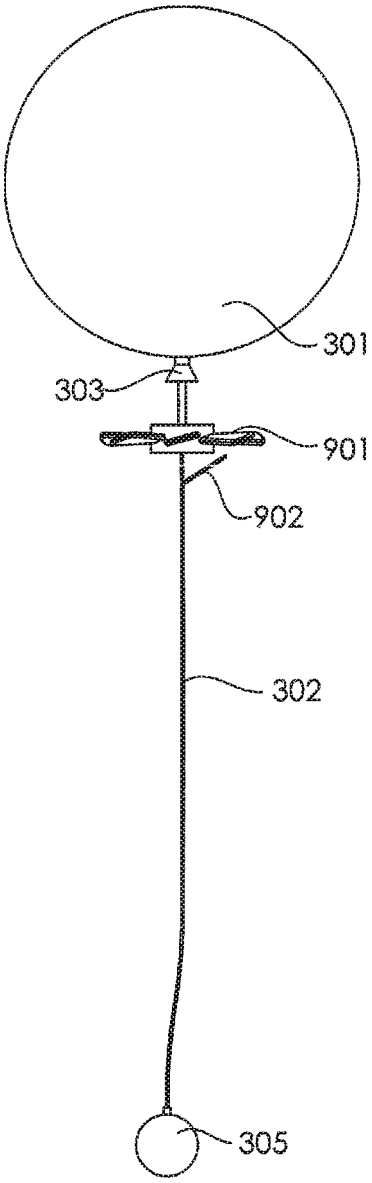
FIG. 9A is a front view of a squirting fan balloon.
Figure 9B:
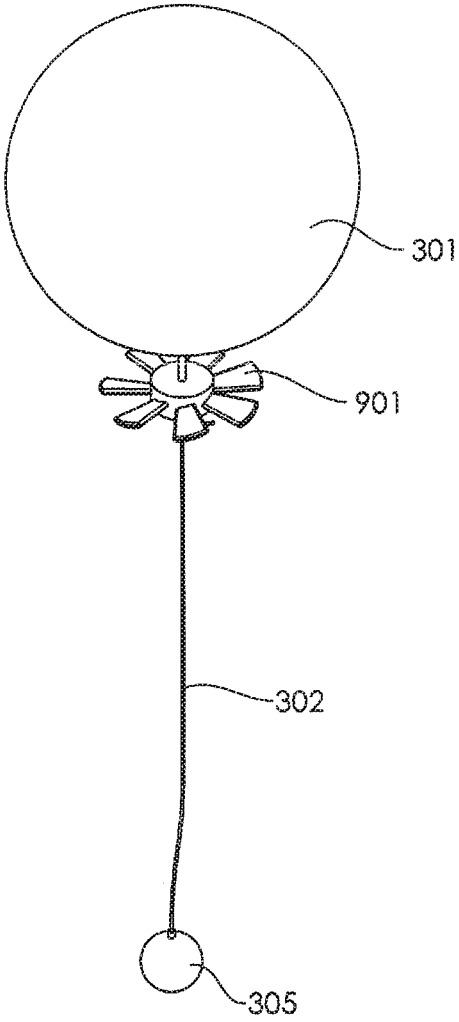
FIG. 9B is an isometric view of a squirting fan balloon.

FIG. 9A is a front view of a squirting fan balloon FIG. 9B is an isometric view of that shown in FIG. 9A. It is comprised of a balloon, 301, a water tube, 302, a pump, 305, a fan, 901, and a water nozzle, 902. Although not shown, the pump may be a device such as that shown in FIG. 1, 102, 106, 107, and FIG. 4, 305, 401, 402, 403, or another mechanism that achieves the same or similar result and function. The fan, 901, spins and keeps the balloon afloat. The fan, 901, also has adjustable speed and position so the balloon can be controlled. The user can move the balloon in any direction and adjust the speed by adjusting the fan, 901. The user can also pump water with the hand pump, 305, and it shoots water out of the water nozzle, 902, which fires into the fan, 901. The liquid sprays out radially after hitting the fan blades, 901. Although shown in only one orientation, it is evident that the fan may be angled at different orientations to either alter the direction of the spray action, or to assist in directional control. One example is rotating the fan 90 degrees so it pushes the balloon forwards.

Figure 9C:
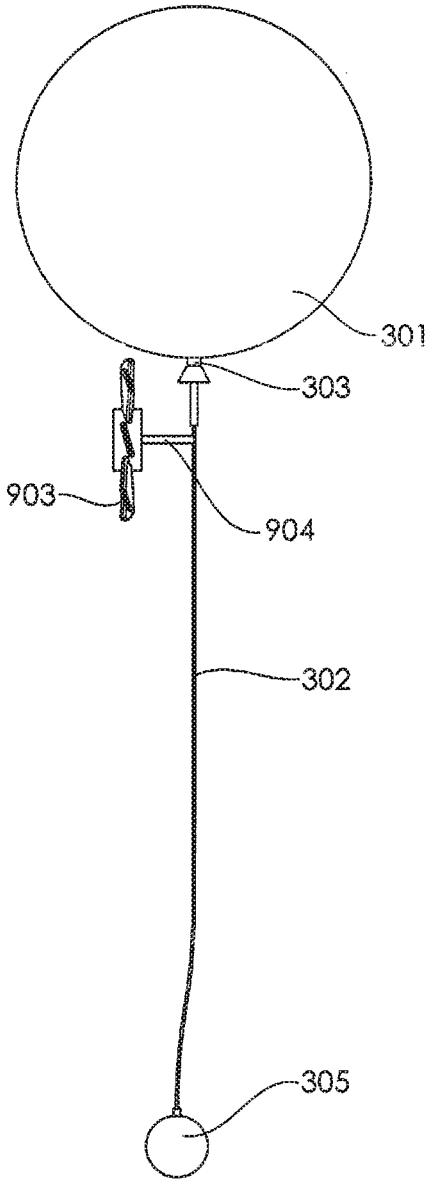
FIG. 9C is a front view of a squirting fan balloon with a horizontal fan.
Figure 9D:
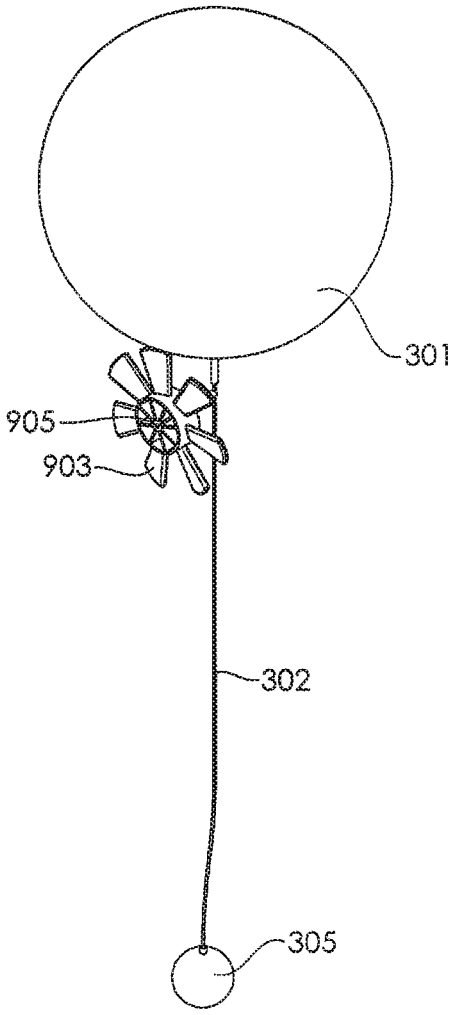
FIG. 9D is an isometric view of a squirting fan balloon with a horizontal fan.

FIGS. 9C and 9D shows the balloon with a propeller or fan rotated 90 degrees so it blows air horizontally. It is comprised of a balloon, 301, a water tube, 302, a pump, 305, a horizontal fan, 903, and a cross tube, 904. FIG. 9D shows the water outlet, 905, in the center of the fan. In this embodiment, water is pumped through the water tube, 302, through the cross tube, 904, and into the horizontal fan, 903. The water turns an internal turbine which turns the outer fan blades, 903. The water exits the water outlet, 905, and the fan, 903 moves air which moves the balloon.

The propeller can be controlled so it changes directions to allow the user to control the movement of the balloon. Multiple fixed propellers can also be placed on the balloon facing different directions so that activating the various propellers will control movement without requiring them to change direction. For example there can be two propellers, one facing forward, and the other facing sideways to control the balloon's movement on a 2D plane. Or there can be three propellers, one facing forward, one facing sideways, and the other facing vertically, so that the balloon can be moved in three dimensions.

There are different ways to power the propeller or fans. One way is for water to squirt onto the fan blades which cause the fan to spin which moves the air. Another way is for water to squirt onto an internal turbine which is connected to the external fan blades. The water hitting the internal turbine blades turn the hub which rotates the fan blades which move air. Another way to power the fan is with offset water streams. For example, fan blades could be added to the disc shown in FIG. 8, so that when the disc spins, the fan blades moves air. Also the fan could be electrically powered.

The direction of the fans or water nozzles can be adjusted a variety of ways including cables, electrical valves or hydraulic valves. Nozzles and fans can also be adjusted manually. For example the user can plug certain nozzles and unplug others to change the way the balloon moves. The user can also adjust rings that snap and rotate so that they block off certain orifices while opening other ones. These various nozzles can oriented in different directions so changing which nozzle is open will change how the balloon moves.

There are many other styling designs that are appropriate for squirting balloons. Some of these include zeppelins, a Death Star, dolphins, and Manneken Pis statues. Lights could also be placed near the nozzle so the water stream could be colored for additional effect. Speakers could be added to the described devices to emit sounds appropriate for the polygon balloon used. For example, a cow's "moo" sound could be added to the udder design in conjunction with the squirting or in addition to it. Additionally, air or compressed air could be substituted for water or added in concert with water from one or multiple tubes for all of the previously described embodiments. One tube could transmit air and water both at different times, or separate tubes could transport gas or liquid concurrently or in sequence. The air could also help offset the loss of buoyancy caused by the addition of water to, through, or adjacent to the balloon, and could be manipulated in concert.

While the apparatus has been described in connection with a preferred embodiment, it is not intended to limit the scope of the apparatus to the particular form set forth, but on the contrary, it is intended to cover such alternatives, modifications, and equivalents as may be within the spirit and scope of the apparatus as defined by the appended claims.

The invention claimed is:

1. A play apparatus comprising:

an inflated balloon;

a connector attached to the balloon for holding the balloon;

at least one reservoir defining a reservoir chamber adapted to contain a body of liquid;

a pump, wherein the play apparatus has an external surface and at least one orifice disposed on the external surface of the play apparatus, the at least one orifice being in fluid communication with the reservoir, wherein the pump is operative to cause liquid in the reservoir to be expelled through the at least one orifice, and wherein the balloon, the connector, the at least one reservoir, and the pump are directly or indirectly coupled together.

2. The play apparatus of claim 1 wherein:

the apparatus further comprises at least one tube that defines a passageway that is in fluid communication with the reservoir;

the at least one orifice is in fluid communication with the passageway; and the pump is operative to move liquid from the reservoir to the at least one orifice via the passageway.

3. The play apparatus of claim 2 wherein at least a portion of the tube extends generally vertically.

4. The play apparatus of claim 2 wherein the tube is flexible.

5. The play apparatus of claim 2 wherein the connector comprises at least a portion of the tube.

6. The play apparatus of claim 1 wherein the at least one orifice is positioned to direct a stream of liquid to a location distant from the balloon.

7. The play apparatus of claim 1 wherein the pump includes an apparatus manipulatable by a user to control a flow of liquid from the reservoir chamber to the at least one orifice.

8. The play apparatus of claim 1 wherein the reservoir is located adjacent to the balloon.

9. The play apparatus of claim 1 wherein the reservoir is coupled to the balloon.

10. The play apparatus of claim 9 wherein the reservoir is coupled to the balloon by hook and loop fastener material attached to a surface of the reservoir and a surface of the balloon respectively.

11. The play apparatus of claim 1 wherein:

the balloon comprises a containment wall that defines a balloon chamber, which chamber contains inflation gas; and at least a portion of the reservoir is located inside the balloon chamber.

12. The play apparatus of claim 1 wherein the reservoir is located at a distance from the balloon.

13. The play apparatus of claim 1 wherein reservoir is located near a location where a person holds the connector.

14. The play apparatus of claim 1 wherein the connector: is substantially rigid and extends generally vertically; and supports the balloon and reservoir.

15. The play apparatus of claim 1 wherein the reservoir comprises a wall that defines the reservoir chamber, at least a portion of the wall being movable such that a person can control a flow of liquid by manually squeezing the reservoir.

16. The play apparatus of claim 1 further comprising an electric pump operable to control a flow of liquid.

17. The play apparatus of claim 1 wherein the at least one orifice oriented to spray liquid radially relative to the connector.

18. The play apparatus of claim 17 further comprising a fan oriented to disburse the liquid radially outwardly relative to the connector.

19. The play apparatus of claim 1 wherein the balloon is lighter than air.

20. The play apparatus of claim 1 wherein:

the connector is flexible; and the balloon is sufficiently buoyant to suspend the connector.

21. The play apparatus of claim 20 wherein:

the play apparatus is not tethered; and the balloon is insufficiently buoyant to lift a person holding the apparatus.

22. A play apparatus comprising:

an inflated balloon;

at least one reservoir, the reservoir defining a reservoir chamber adapted to contain a body of liquid;

a connector that is attached to the balloon and that is secured at an attachment location that is remote from the balloon, the connector comprising a flexible tube that defines a passageway that is in fluid communication with the reservoir; and a pump, wherein the play apparatus has an external surface and at least one orifice disposed on the external surface, the at least one orifice being located remote from the reservoir and being in fluid communication with the passageway, wherein the pump is operative to move liquid from the reservoir to the at least one orifice via the passageway and that is operative to pressurize fluid within the passageway and thereby rigidify and straighten the tube and cause the balloon to move away from the attachment location, and wherein the balloon, the connector, the at least one reservoir, and the pump are directly or indirectly coupled together.

23. A play apparatus comprising:

an inflated balloon;

a connector attached to the balloon for holding the balloon;

at least one reservoir defining a reservoir chamber adapted to contain a body of liquid;

wherein the play apparatus has an external surface and at least one orifice disposed on the external surface, the at least one orifice being in fluid communication with the reservoir, a mechanism that is operative to cause liquid in the reservoir to be expelled through the at least one orifice; and wherein the balloon, the connector, the at least one reservoir, and the mechanism are directly or indirectly coupled together.

24. A play apparatus comprising:

an inflated balloon;

a connector attached to the balloon for holding the balloon;

at least one reservoir defining a reservoir chamber adapted to contain a body of fluid; and a pump wherein the play apparatus has an external surface and at least one orifice disposed on the external surface, the at least one orifice being in fluid communication with the reservoir, wherein the pump is operative to cause fluid in the reservoir to be expelled through the at least one orifice, and wherein the balloon, the connector, the at least one reservoir, and the pump are directly or indirectly coupled together.

* * * * *